US006179658B1

(12) United States Patent
Gunay et al.

(10) Patent No.: US 6,179,658 B1
(45) Date of Patent: Jan. 30, 2001

(54) SEALING ARRANGEMENT BETWEEN AN ELECTRICAL CONNECTOR AND AN ELECTRICAL CONDUCTOR

(75) Inventors: Tarik Gunay, Neuss; Wulf Bramesfeld, Wulfrath; Udo Diedrich, Gevelsberg, all of (DE)

(73) Assignee: Delphi Technologies, Inc., Troy, MI (US)

( * ) Notice: Under 35 U.S.C. 154(b), the term of this patent shall be extended for 0 days.

(21) Appl. No.: 09/360,939

(22) Filed: Jul. 26, 1999

(30) Foreign Application Priority Data

Aug. 6, 1998 (DE) ..... 198 35 670

(51) Int. Cl.[7] ..... H01R 13/40

(52) U.S. Cl. ..... 439/587; 439/272; 439/936; 439/519

(58) Field of Search ..... 439/519, 587, 439/936, 588, 271, 272–273, 274, 275

(56) References Cited

U.S. PATENT DOCUMENTS

| | | | |
|---|---|---|---|
| 4,778,403 | 10/1988 | Ikesugi et al. . | |
| 5,557,073 | 9/1996 | Truesdale, Jr. et al. . | |
| 5,716,235 * | 2/1998 | Endo et al. | 439/596 |

FOREIGN PATENT DOCUMENTS

| | | |
|---|---|---|
| 85 11 822 U1 | 6/1985 | (DE) . |
| 0851536A2 | 7/1998 | (EP) . |
| 197 57 282A1 | 7/1998 | (DE) . |
| 197 57 672A1 | 7/1998 | (DE) . |
| 198 00 453A1 | 7/1998 | (DE) . |
| 2660118 | 9/1991 | (FR) . |
| WO96/29760 | 9/1996 | (WO) . |

* cited by examiner

*Primary Examiner*—Paula Bradley
*Assistant Examiner*—Truc Nguyen
(74) *Attorney, Agent, or Firm*—Richard A. Jones

(57) ABSTRACT

A sealing arrangement (10) between an electrical connector (12) and an electrical conductor (14), such as an FPC, in which the electrical conductor extends through an aperture (18) in a housing (16) of the electrical connector, the sealing arrangement being positioned adjacent the aperture and comprising a flap member (22) which is pivotally mounted and movable between an open position and a closed position, the flap member being positioned on one side of the electrical conductor; a wall (20) positioned on the opposite side of the electrical conductor to the flap member; and a compressible seal (24) positioned around the electrical conductor; wherein, in the closed position of the flap member, the flap member, the wall and the electrical conductor lie in planes which are substantially parallel; and the seal is compressed between the flap member and the wall and partially extruded into the aperture. Easy assembly.
FIG. 2 to accompany the abstract.

11 Claims, 3 Drawing Sheets

SEALING ARRANGEMENT BETWEEN AN ELECTRICAL CONNECTOR AND AN ELECTRICAL CONDUCTOR

TECHNICAL FIELD

The present invention relates to a sealing arrangement between an electrical connector and an electrical conductor, and in particular to a sealing arrangement between an electrical connector and a substantially flat electrical conductor (such as a flexible print circuit).

BACKGROUND OF THE INVENTION

In order to electrically connect a flexible printed circuit (FPC) to another FPC or to an electrical component, it is necessary to secure a electrical connector to the FPC. In such an arrangement, the FPC passes through an aperture in the housing of the electrical connector. To provide a substantially watertight seal between the FPC and the housing, the housing or part of the housing is moulded around the FPC or the FPC is secured to the housing by hot-melt adhesive. These known arrangements have disadvantages in terms of assembly or processing time, and temperature stresses on the FPC.

SUMMARY OF THE INVENTION

It is an object of the present invention to overcome the above mentioned disadvantages.

A sealing arrangement in accordance with the present invention between an electrical connector and an electrical conductor in which the electrical conductor extends through an aperture in a housing of the electrical connector, the sealing arrangement being positioned adjacent the aperture and comprising a flap member which is pivotally mounted and movable between an open position and a closed position, the flap member being positioned on one side of the electrical conductor; a wall positioned on the opposite side of the electrical conductor to the flap member; and a compressible seal positioned around the electrical conductor; wherein, in the closed position of the flap member, the flap member, the wall and the electrical conductor lie in planes which are substantially parallel; and the seal is compressed between the flap member and the wall and partially extruded into the aperture.

Compared to previously known arrangements, the present invention provides a sealing arrangement which is quicker and easier to assemble, and which does not subject the electrical connector to temperature stresses.

BRIEF DESCRIPTION OF THE DRAWINGS

The present invention will now be described, by way of example, with reference to the accompanying drawings, in which.

DESCRIPTION OF THE PREFERRED EMBODIMENT

Figure 1:
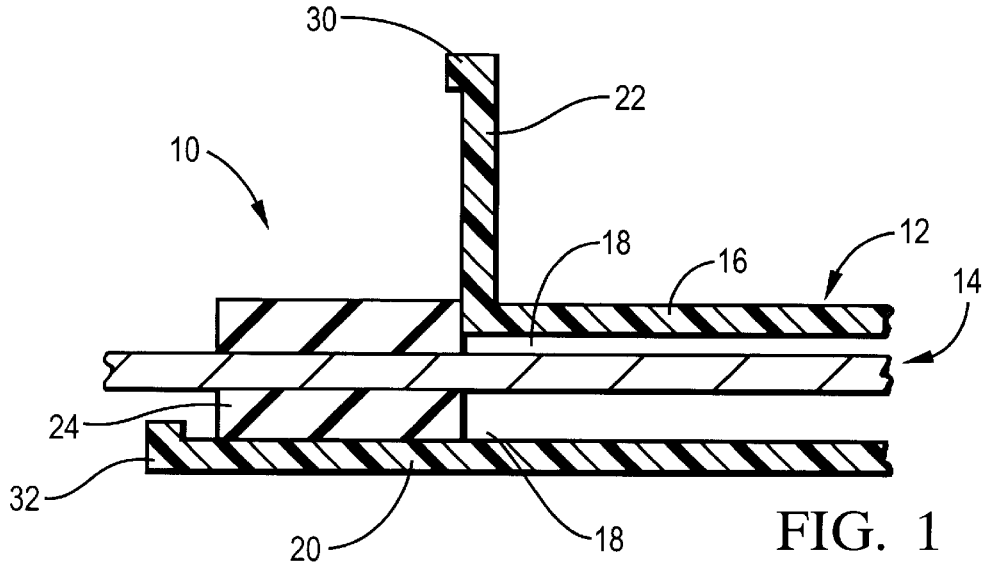
FIG. 1 is a cross-sectional view of a sealing arrangement in accordance with the present invention prior to installation.
Figure 2:
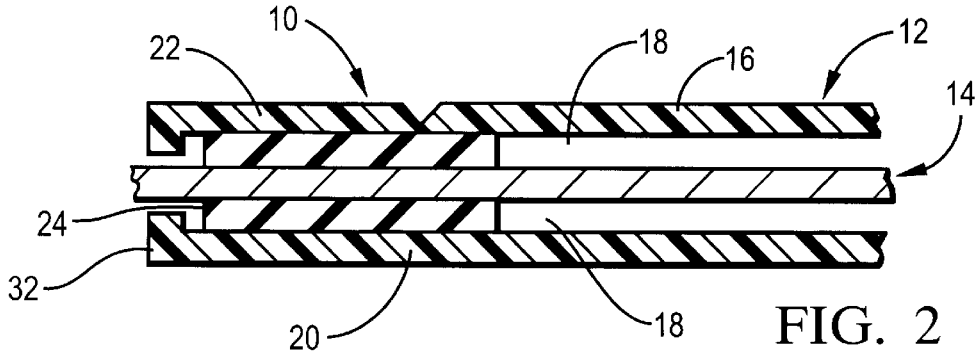
FIG. 2 is a cross-sectional view of the sealing arrangement of FIG. 1 after installation.
Figure 3:
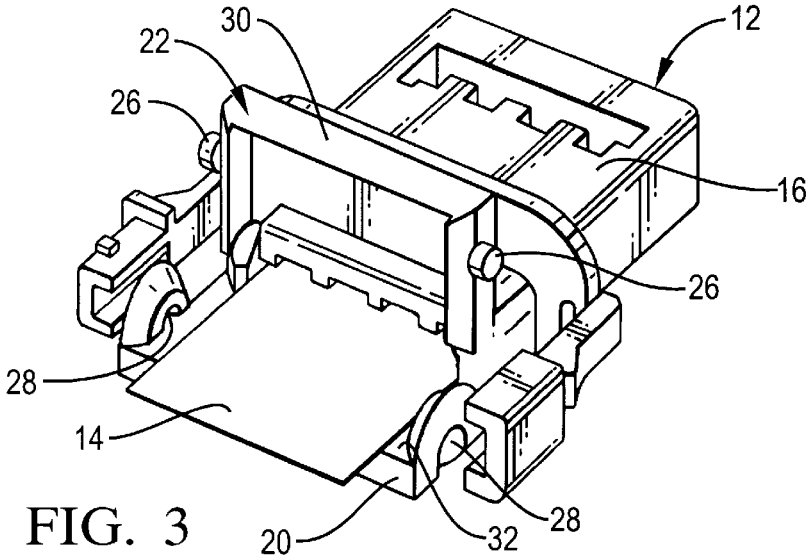
FIG. 3 is a perspective view of the sealing arrangement of FIG. 1 with the seal omitted for clarity.

FIGS. 1 to 3 show a first embodiment of sealing arrangement 10, in accordance with the present invention, between an electrical connector 12 and an electrical conductor 14. The electrical conductor 14 is a flexible printed circuit (FPC). The electrical connector 12 is a female electrical connector and comprises a housing 16 with an aperture 18. The FPC 14 passes through the aperture 18 and is electrically connected with one or more terminals (not shown) positioned inside the housing 16. The sealing arrangement 10 comprises a wall 20 integral with the housing 16 and which extends away from one side of the aperture 18; a flap member 22 pivotally attached to the housing on the other side of the aperture; and a compressible seal 24 which substantially surrounds the FPC 14 adjacent the aperture. The seal 24 is preferably preformed as best shown in FIG. 1. The flap member 22 is movable between an open position as shown in FIG. 1 and a closed position as shown in FIG. 2. In the closed position, the wall 20, flap member 22, and FPC 14 lie in planes which are substantially parallel. The FPC 14 is inserted through the aperture 18 when the flap member 22 is in the open position. The seal 24 may be positioned adjacent the aperture 18 either prior to or after insertion of the FPC 14 through the aperture. The flap member 22 is then moved to the closed position. In the closed position, the seal 24 is compressed between the wall 20 and the flap member 22 and partially extruded into the aperture 18 to form a substantially fluid tight seal with the FPC 14 and with the housing 16. The flap member 22 is retained in the closed position by tabs 26 on the flap member which make a snap fit behind corresponding shoulders 28 formed on the wall 20. The flap member 22 preferably has a shoulder 30 formed at its free edge, and the wall 20 preferably has a similar shoulder 32 at its free edge, to reduce the risk of extrusion of the seal 24 away from the aperture 18. The seal 24 is of a predetermined size to ensure that the seal is compressed on moving the flap member 22 to the closed position. The seal 24 is preferably formed from silicone gel. The seal 24 may be formed in one piece and be substantially annular, with the FPC 14 passing through the seal during insertion of the FPC through the aperture 18. Alternatively, the seal 24 may be formed in two parts, with one part secured to the flap member 22 prior to compression, and the other part secured to the wall 20 prior to compression.

Figure 4:
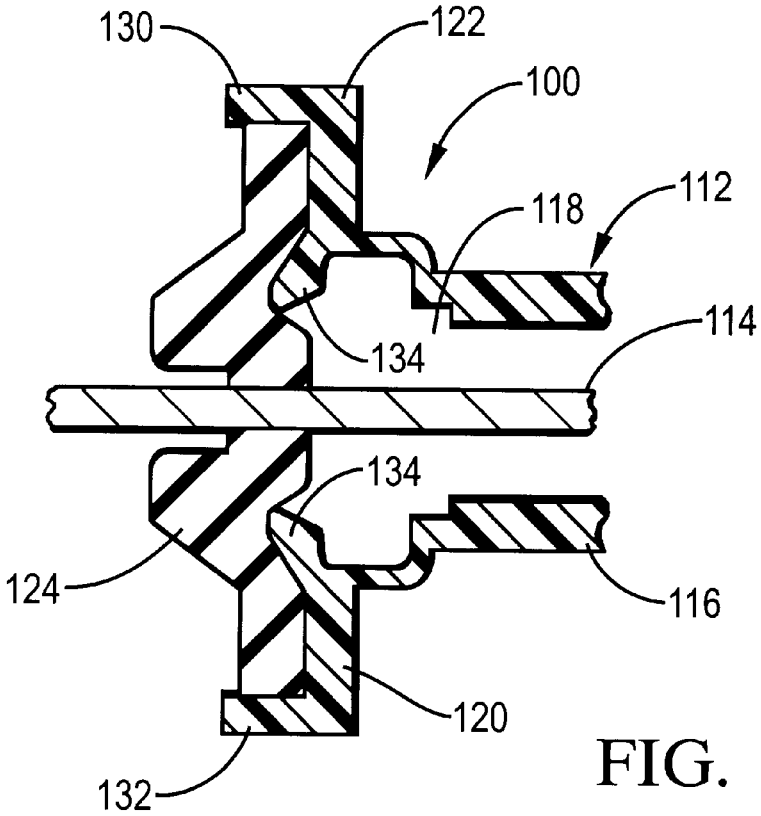
FIG. 4 is a cross-sectional view of a second embodiment of sealing arrangement in accordance with the present invention prior to installation.
Figure 5:
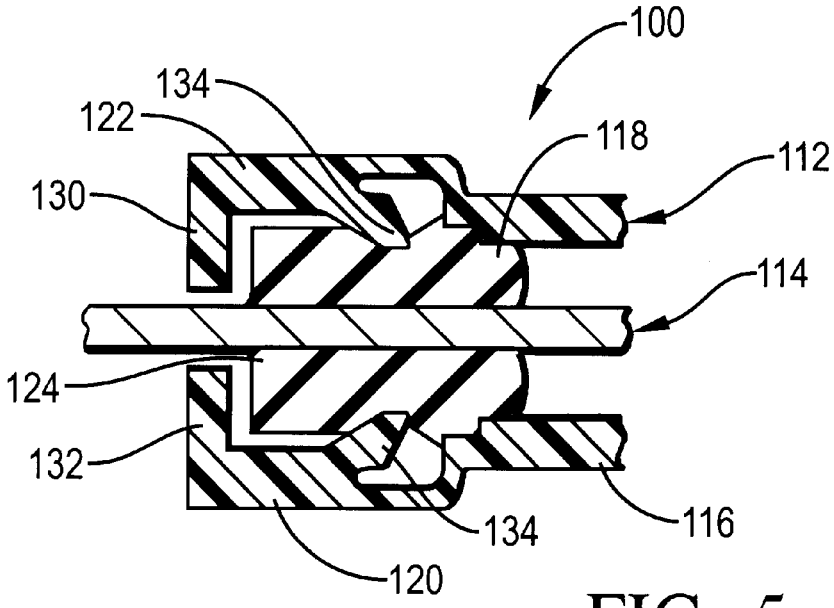
FIG. 5 is a cross-sectional view of the sealing arrangement of FIG. 3 after installation.

FIGS. 4 and 5 show a second embodiment of sealing arrangement 100 in accordance with the present invention. As with the above described first embodiment, the sealing arrangement 100 provides a seal between an electrical connector 112 and an FPC 114. The electrical connector 112 comprises a housing 116 with an aperture 118, and the FPC 114 extends through the aperture. In the second embodiment, when compared to the first embodiment, the wall is replaced by a second flap member 120. The sealing arrangement 100 comprises a first flap member 122 pivotally attached to the housing 116 on one side of the aperture 118, the second flap member 120 pivotally attached to the housing on the opposite side of the aperture, and a compressible seal 124. The flap members 120,122 are movable between an open position as shown in FIG. 4 and a closed position as shown in FIG. 5. In the closed position, the flap member 120, the flap member 122, and the FPC 114 lie in planes which are substantially parallel to one another. The seal 124 is substantially annular and the FPC 114 passes through the seal during insertion of the FPC through the aperture 118. In the open position of the flap member 120,122, the seal 124 engages the flap members. On closing the flap members 120,122, the seal 124 is compressed between the flap members and partially extruded into the aperture 118 to provide a substantially fluid tight seal with the FPC 114 and with the housing 116. The first flap member 122 preferably has a shoulder 130 formed at its free edge, and the second flap member 120 preferably has a similar shoulder 132 at its free edge, to reduce the risk of extrusion of the seal 124 away from the aperture 118. The flap members 120,122 preferably each have an angled lip 134 formed thereon which in the closed position of the flap members is directed towards the aperture 118 in the housing 116. The angled lips 134 assist in compressing the seal 124 and in pushing a portion of the seal into the aperture 118. The flap members 120,122 may be retained in the closed position by any suitable snap-fit arrangement. The seal 124 is of a predetermined size to ensure that the seal is compressed on moving the flap members 120,122 to the closed position. The seal 124 is preferably formed from silicone gel.

Figure 6:
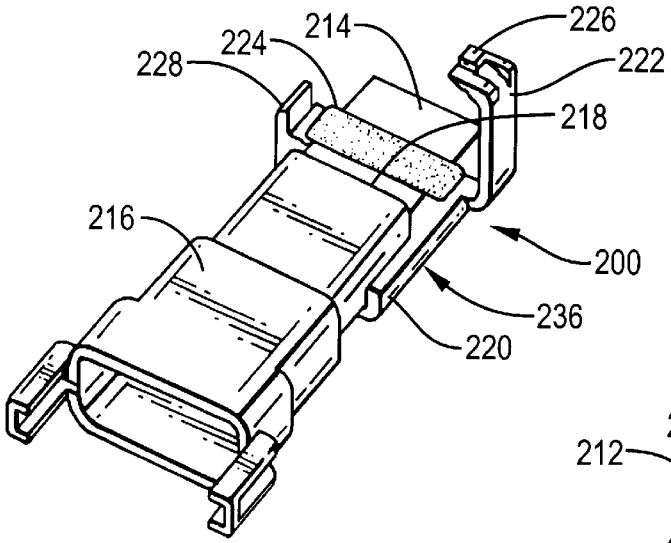
FIG. 6 is a perspective view of a third embodiment of sealing arrangement in accordance with the present invention.
Figure 7:
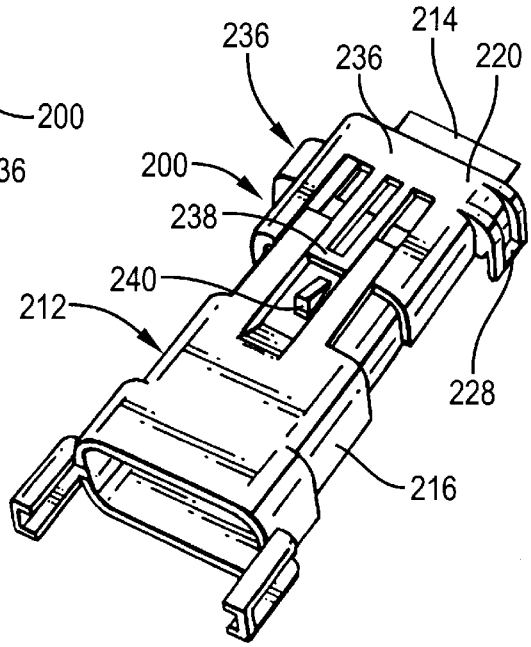
FIG. 7 is a perspective view of the sealing arrangement of FIG. 6 from the reverse side.
Figure 8:
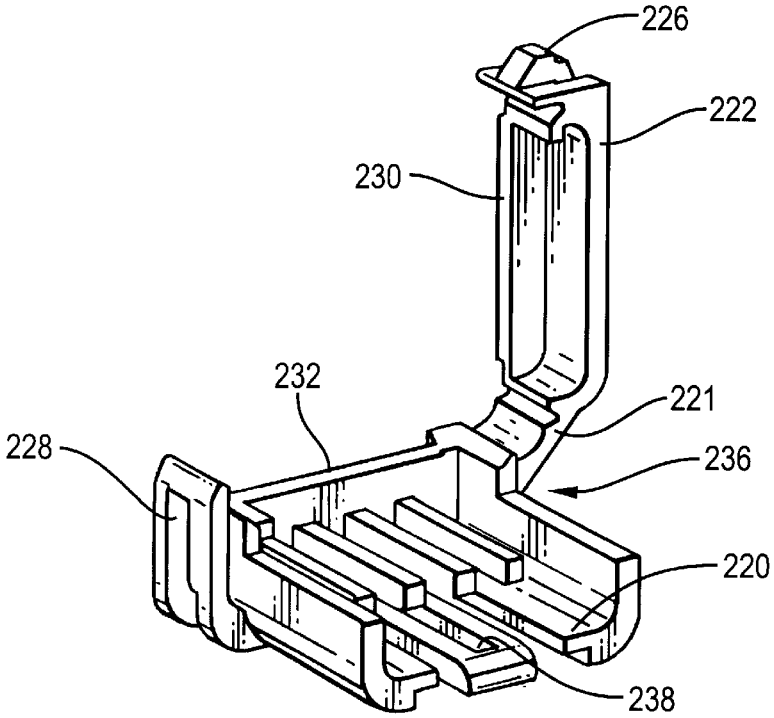
FIG. 8 is a perspective view of the seal clamping device of the sealing arrangement shown in FIGS. 6 and 7.

FIGS. 6 to 8 show a third embodiment of sealing arrangement 200 in accordance with the present invention. As with the above described first embodiment, the sealing arrangement 200 provides a seal between an electrical connector 212 and an FPC 214. The electrical connector 212 is a male connector and comprises a housing 216 with an aperture 218, and the FPC 214 extends through the aperture. In the third embodiment, when compared to the first embodiment, the wall 220 and the flap member 222 are on a separately formed seal clamping device 236. The sealing arrangement 200 comprises the wall 220, the flap member 222 which is pivotally attached to the wall, and a compressible seal 224. The flap member 222 is pivotally attached to the wall by a hinge 221 that is generally parallel to the electrical conductor 214 as shown in FIGS. 6 and 8. The seal clamping device 236 makes a sliding fit (in a direction towards the aperture 218) on the housing 216 and has a shoulder 238 on the wall 220 which makes a snap fit with a corresponding tab 240 on the housing to retain the seal clamping device on the housing. The flap member 222 is movable between an open position as shown in FIGS. 6 and 8, and a closed position, as shown in FIG. 7. In the closed position, the wall 220, flap member 222, and FPC 214 lie in planes which are substantially parallel to one another. The FPC 214 is inserted through the aperture 218 when the flap member 222 is in the open position. The seal 224 may be positioned around the FPC 214 either prior to or after insertion of the FPC through the aperture 218. The flap member 222 is then moved to the closed position and the seal clamping device 236 is then slid and snap fitted to the housing 216. In this arrangement, the seal 224 is compressed between the wall 220 and the flap member 222 and partially extruded into the aperture 218 to form a substantially fluid tight seal with the FPC 214 and with the housing 216. The flap member 222 is retained in the closed position by a tab 226 on the flap member which make a snap fit behind a corresponding shoulder 228 formed on the wall 220. The flap member 222 preferably has a shoulder 230 formed at its edge remote from the aperture 218, and the wall 220 preferably has a similar shoulder 232 at its edge remote from the aperture, to reduce the risk of extrusion of the seal 224 away from the aperture 218. The seal 224 is of a predetermined size to ensure that the seal is compressed on moving the flap member 222 to the closed position. The seal 224 is preferably formed from silicone gel. The seal 224 may be formed in one piece and be substantially annular, with the FPC 214 passing through the seal during insertion of the FPC through the aperture 218. Alternatively, the seal 224 may be formed in two parts, with one part secured to the flap member 222 prior to compression, and the other part secured to the wall 220 prior to compression.

The above described embodiments refer to the electrical conductor being an FPC 14. It will be appreciated that the present invention is also usable with other types of electrical conductor, especially electrical conductors which are substantially flat.

The present invention provides a seal between an electrical connector and an electrical conductor which is easy to assemble, and which does not subject the electrical conductor to temperature stresses. Further, the present invention does not raise issues regarding material compatibility as with the above mentioned prior known arrangements, and disassembly is possible without damaging the conductor or the connector.

What is claimed is:

1. A sealing arrangement (100) for an electrical connector (112) comprising:

an electrical conductor (114);

a housing (116) of the electrical connector, the housing having an aperture (118), the electrical conductor extending through the aperture;

a first flap member (122) formed integrally to the housing and in communication with the aperture;

a second flap member (120) formed integrally to the housing and in communication with the aperture, the first and second flap members disposed in opposition about the aperture, the first and second flap members mounted pivotally and moveable between an open position and a closed position, when in the closed position the first and second flap members and the electrical conductor lie in substantially parallel planes, at least one of the flap members (122, 120) having an angled lip (134) directed towards the aperture; and a preformed compressible seal (124) disposed compressibly between the first and second flap members, the preformed compressible seal positioned around the electrical conductor, the preformed compressible seal partially extruded into the aperture by a force exerted by the at least one angled lip when the first and second members are in the closed position.

2. A sealing arrangement as claimed in claim 1, wherein the flap members (122, 120) have shoulders (130,132) respectively at edges remote from the aperture (118).

3. A sealing arrangement as claimed in claim 2, wherein the preformed seal (124) is formed from silicone gel.

4. A sealing arrangement as claimed in claim 3, wherein the flap members (122, 120) snap fit together when in the closed position.

5. A sealing arrangement as claimed in claim 1, wherein the electrical conductor (114) is a flex circuit.

6. A sealing arrangement (200) for an electrical connector (212) comprising:

an electrical conductor (214);

a housing (216) having and defining an aperture (218), the electrical conductor extending through the aperture;

a seal clamping device (236) slideable on and securable to the housing of the electrical connector, the seal clamping device in communication with the aperture, the seal clamping device having a flap member (222), a hinge (221) and a wall (220), the flap member and the wall being integrally formed and pivotally connected via the hinge, the hinge parallel to the electrical conductor, the flap member and the wall pivotally moveable between an open position and a closed position, the pivotal movement substantially perpendicular to the electrical conductor, the flap member and the wall disposed in opposition about the electrical conductor, when in the closed position the flap member, the wall and the electrical conductor lie in planes which are substantially parallel; and a preformed compressible seal (224) positioned around the electrical conductor and compressed between the flap member and the wall when the flap member is in the closed position, the preformed compressible seal further extruded into the aperture of the housing of the electrical connector when the seal clamping device is locked into the housing.

7. A sealing arrangement as claimed in claim 6, wherein the flap member (222) and the wall (220) each have a shoulder (230,232) at their edges remote from the aperture (218).

8. A sealing arrangement as claimed in claim 7, wherein the preformed compressible seal (224) is formed from silicone gel.

9. A sealing arrangement as claimed in claim 7, wherein the preformed compressible seal (224) is substantially annular.

10. A sealing arrangement as claimed in claim 9, wherein the flap member (222) makes a singular snap fit with the wall (220) in the closed position of the flap member.

11. A sealing arrangement as claimed in claim 6, wherein the electrical conductor (214) is a flex circuit.

* * * * *